US006176209B1

(12) United States Patent
Ishii

(10) Patent No.: US 6,176,209 B1
(45) Date of Patent: Jan. 23, 2001

(54) ELECTROMAGNETICALLY OPERATED VALVE CONTROL SYSTEM AND THE METHOD THEREOF

(75) Inventor: Mitsunori Ishii, Tokyo (JP)

(73) Assignee: Fuji Jukogyo Kabushiki Kaisha, Tokyo (JP)

( * ) Notice: Under 35 U.S.C. 154(b), the term of this patent shall be extended for 0 days.

(21) Appl. No.: 09/371,869

(22) Filed: Aug. 5, 1999

Related U.S. Application Data

(62) Division of application No. 09/032,598, filed on Feb. 27, 1998, now Pat. No. 5,964,192.

(30) Foreign Application Priority Data

Mar. 28, 1997 (JP) ..... 9-78605

(51) Int. Cl.[7] ..... F01L 9/04
(52) U.S. Cl. ..... 123/90.11
(58) Field of Search ..... 123/90.11, 90.15; 251/129.01, 129.1

(56) References Cited

U.S. PATENT DOCUMENTS 5,964,192 * 10/1999 Ishii ..... 123/90.11
6,047,672 * 4/2000 Hanai et al. ..... 123/90.11

* cited by examiner

*Primary Examiner*—Teresa Walberg
*Assistant Examiner*—Vinod D. Patel
(74) *Attorney, Agent, or Firm*—Martin A. Farber

(57) ABSTRACT

The system and method for controlling an electomagnetically operated valve driving mechanism comprises an actuator, an actuator drive circuit, a lift sensor, an actuator control apparatus, and a micro-computer. The actuator includes a valve opening solenoid and a valve closing solenoid. The actuator control apparatus generates signals for energizing and deenrgizing the valve opening solenoid and the valve closing solenoid based on control data supplied from the lift sensor and the micro-computer. The feature of this system is to control the elecromagnetically operated valve driving mechanism only by the actuator control apparatus but not by the micro-computer in a precise and sophisticated manner, thereby a burden on the micro-computer can be lightened.

3 Claims, 14 Drawing Sheets

ELECTROMAGNETICALLY OPERATED VALVE CONTROL SYSTEM AND THE METHOD THEREOF

RELATED APPLICATION

This application is a divisional application of my application Ser. No. 09/032,598 filed Feb. 27, 1998 now U.S. Pat. No. 5,964,192, the entire contents of which is hereby incorporated by reference herein.

BACKGROUND OF THE INVENTION

1. Field of the Invention

The present invention relates to a system and method for controlling electromagnetically operated intake and exhaust valves of an internal combustion engine.

2. Prior Arts

An elctromagnetically operated valve mechanism is of a valve driving technique in which a valve body is operated by generating magnetic force in an actuator by supplying current thereto and there are numerous proposed techniques relating to that mechanism. The electromagnetically operated valve mechanism is characterized in that the construction of the valve driving mechanism can be simplified because of the absence of a cam mechanism and further the valve opening and closure timing of the intake and exhaust valves can be selectively established according to engine operating conditions, this enabling a wide range of selection of engine output characteristics and further leading to an improvement of fuel economy.

FIG. 14 is a schematic cross sectional view showing an example of an electromagnetically operated valve mechanism according to the prior art. The shown electromagnetically operated valve mechanism is an example employed on the exhaust valve side. With respect to the intake valve side, its detailed description will be omitted because of a similar construction. As shown, generally, the electromagnetically operated valve mechanism 110 comprises a valve body 120, an electromagnetic force generating section 130, a biasing section 140 and an armature 150. Also the valve body 120 comprises a valve 121 and a valve stem 122 and it is reciprocatably supported by a stem guide 161 provided in a cylinder head 160.

The valve 121 is formed so as to have a close contact with a valve seat 164 provided around an exhaust port end 163. Further, the valve stem 122 is connected at the top end thereof with the armature 150 fabricated of magnetic material.

The electromagnetic force generating section 130 is constituted by an electromagnetic solenoid 131 for closing a valve (hereinafter, referred to as valve closing solenoid, an electromagnetic solenoid 132 for opening a valve (hereinafter, referred to as valve opening solenoid), a first core 133 for the valve closing solenoid 131 and a second core 134 for the valve opening solenoid 132. The armature 150 is inserted between the first and second cores 133, 134 so as to move vertically therebetween.

The biasing section 140 comprises a spring 141 for opening a valve (hereinafter, referred to as valve opening spring) and a spring 142 for closing a valve (hereinafter, referred to as valve closing spring). The valve opening spring 141 is provided between the first core 133 and the valve stem 122 so as to bias the valve body 120 in the opening direction (downward direction in this drawing) with a specified biasing force. Further, the valve closing spring 142 is provided between the second core 134 and the armature 150 so as to bias the valve body 120 in the closing direction (upward direction in this drawing) with a specified biasing force.

When the valve closing solenoid 131 and the valve opening solenoid 132 are both deenergized, the valve opening spring 141 and the valve closing spring 142 have such a biasing force respectively that the armature 150 is sustained at about the mid-point between the first and second cores 133, 134. Therefore, when either of these solenoids 131, 132 is energized, the armature 150 can be attracted with less attraction force.

Describing an operation of this valve mechanism briefly, first, when the valve closing solenoid 131 is energized, an electromagnetic force is generated in the valve closing solenoid 131 to attract the armature 150 in the direction of the valve closing solenoid 131 against the biasing force of the valve opening spring 141 and as a result the valve body 120 travels in the closing direction (upward direction in this drawing) until the valve 121 comes into close contact with the valve seat 164. Thus, the combustion chamber 165 is sealed up against the exhaust port 162.

When the valve opening solenoid 132 is energized, the armature 150 is attracted toward the valve opening solenoid 132 to move the valve body 120 in the opening direction (downward direction) until the valve 121 is fully open.

FIG. 14 shows a state in which the electromagnetic force generating section 130 is deenergized and the armature 150 is positioned at the mid-point of the first core 133 and the second core 134.

Japanese Patent Application Laid-open No. Toku-Kai-Shou 61-76713 discloses an electromagnetically operated valve control system in which the valve speed immediately before seating on the valve seat is reduced to alleviate an impact when seated. Further, Japanese Patent Application Laid-open No. Toku-Kai-Hei 7-224624 discloses an electromagnetically operated valve train apparatus wherein the lift amount is detected by a lift sensor.

In applying the foregoing electromagnetically operated valve train system to a multi-cylinders engine, the current control must be performed per respective electromagnetic solenoids provided on each cylinder. In case of an electromagnetically operated valve train system as shown in FIG. 14, two electromagnetic solenoids, one for opening the valve and the other for closing the valve, are employed. Therefore, for example, in case of a four cylinders-four valves engine, thirty-two (32) electromagnetic solenoids must be controlled independently.

In order to generate signals for driving these numerous electromagnetic solenoids in the micro-computer in a timely manner, it is necessary to increase the number of channels and to enlarge the computing capacity of the micro-computer. Further, when performing such a fine valve opening and closing control as proposed in Toku-Kai-Shou 61-76713 or Toku-Kai-Hei 7-224624, still greater burden is charged on the micro-computer.

Therefore, in order to perform the above-mentioned valve opening and closing control, a high performance computer must be used, this resulting in a cost increase of the system.

SUMMARY OF THE INVENTION

With the above described problem in mind, it is an object of the present invention to provide an electromagnetically operated valve control system capable of performing a more precise and more sophisticated valve driving control with less burden on the micro-computer.

In order to achieve the above-mentioned object, the electromagnetically operated valve control system comprises: control data generating means for generating a control data based on operating conditions of the engine, valve position detecting means for detecting reference positions of the valve body, valve closing acceleration means for energizing a valve closing solenoid when the valve body passes a first reference position apart from the fully open position and for deenergizing a valve closing solenoid when the valve body passes a second reference position closer to the fully closed position than the first reference position, valve seating velocity adjusting means for energizing the valve closing solenoid when the valve body passes a third reference position closer to the fully closed position than the second reference position and for deenergizing the valve closing solenoid when the valve body passes a fourth reference position closer to the fully closed position than the third reference position so as to adjust a seating velocity of the valve body, valve closing hold means for repeatedly energizing and deenergizing the valve closing solenoid when the valve body passes the fourth reference position and for deenergizing the valve closing solenoid when a first specified period has elapsed since the valve body passes the fourth reference position, valve opening acceleration means for energizing the valve opening solenoid when the valve body passes a fifth reference position apart from the fully closed position and for deenergizing the valve opening solenoid when the valve body passes a sixth reference position closer to the fully open position than the fifth reference position, valve opening velocity adjusting means for energizing the valve opening solenoid when the valve body passes a seventh reference position closer to the fully open position than the sixth reference position and for deenergizing the valve opening solenoid when the valve body passes an eighth reference position closer to the fully open position than the seventh reference position so as to adjust an opening velocity of the valve body, and valve opening hold means for repeatedly energizing and deenergizing the valve opening solenoid when the valve body passes the eighth reference position and for deenergizing the valve closing solenoid when the second specified period has elapsed since the valve body passes the eighth reference position so as to hold the valve body at the fully open position.

BRIEF DESCRIPTION OF THE DRAWINGS

By way of example only, a specific embodiment of the present invention will now be described, with reference to the accompanying drawings, in which.

DETAILED DESCRIPTION OF PREFERRED EMBODIMENTS

Figure 1:
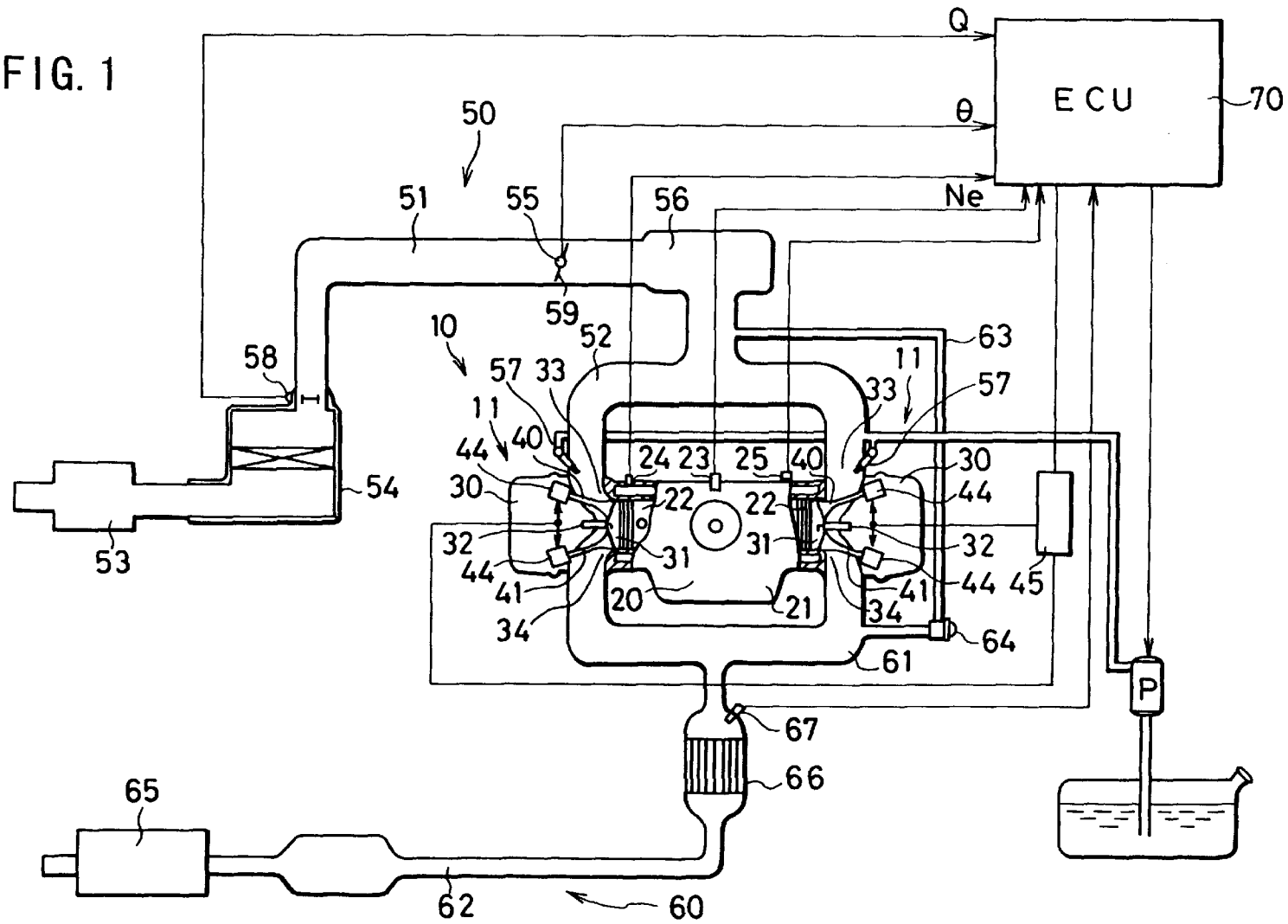
FIG. 1 is an overall schematic view showing an electromagnetically operated valve control system according to the present invention.

Referring now to FIG. 1, numeral 10 denotes a horizontally opposed engine, numeral 50 denotes an air intake passageway, and numeral 60 denotes an exhaust passageway. The engine 10 has a plurality of cylinders 11 and it comprises a cylinder block 20 and a cylinder head 30. The cylinder block 20 has an oil pan 21 at the central portion thereof, a plurality of cylinder bores (not shown) on the left and right sides thereof and a plurality of pistons 22 are reciprocatably inserted into the cylinder bores through a crank shaft (not shown)and a connecting rod (not shown).

Further, in the cylinder block 20 there are provided with a crank angle sensor 23 for detecting engine speed Ne and crank angle, a coolant temperature sensor 24 for detecting coolant temperature and a knock sensor 25 for detecting knocking. These sensors act as detecting engine operating conditions to be used for determining the valve opening and closing timing.

The cylinder head 30 has a combustion chamber 31 for each cylinder 11 and a spark plug 32 is projected into the combustion chamber 31. The spark plug 32 serves as igniting mixture gas supplied to the combustion chamber 31 with high voltage applied by an ignitor (not shown) and an ignition coil (not shown) at a specified ignition timing.

Further, the cylinder head 30 has an air intake port 33 communicating with the air intake passageway 50 for feeding mixture gas to the combustion chamber 31 and an exhaust port 34 communicating with the exhaust passageway 60 for discharging exhaust gases.

Further, there are provided with an intake valve 40 for communicating or shutting off the passage between the air intake port 33 and the combustion chamber 31 and an exhaust valve 41 for communicating or shutting off the passage between the exhaust port 34 and the combustion chamber 31. The communication is performed by means of opening the passage between the air intake port 33 or the exhaust port 34 and the combustion chamber 31 by moving the intake valve 40 or the exhaust valve 41 in the direction of the combustion chamber 31 and the shutting-off is performed by means of closing the passage between the air intake port 33 or the exhaust port 34 and the combustion chamber 31 by returning the intake valve 40 or the exhaust valve 41 in the opposite direction.

Further, the cylinder head 30 has an actuator 44 for opening and closing the intake valve 40 and the exhaust valve, respectively. The actuator 44 opens and closes the intake valve 40 and the exhaust valve 41 by passing and shutting off current supplied from an actuator drive circuit 45.

The air intake passageway 50 is constituted by an intake passage 51 and an intake manifold 52. The intake passage 51 has, in the order arranged from upstream to downstream, an intake chamber 53 for reducing pulsation of intake air, an air cleaner 58 for removing dusts in the air and a throttle valve 55 for controlling the intake air amount Q according to the amount of depression of an accelerator pedal (not shown).

The intake manifold 52 has a surge tank 56 downstream of the throttle valve 55 and branches at the downstream portion of the surge tank 56 into a plurality of manifolds communicating with an intake port 33 for each cylinder 11. Further, a fuel injector 57 is provided at the downstream end of each manifold so as to inject fuel towards the intake port 33.

The exhaust passageway 60 is constituted by an exhaust manifold 61 and an exhaust passage 62. The exhaust manifold 61 has such a configuration as enabling to collect exhaust gas from each cylinder. Further, there is provided with an EGR passage 63 having a smaller passage area than that of the intake manifold 52 or the exhaust manifold 61 so as to communicate between both branch points of the intake manifold 52 and the exhaust manifold 61 and further, on the way of the EGR passage 63 there is provided with an EGR valve 64 driven by a stepping motor, for example.

The exhaust passage 62 is connected upstream thereof with the exhaust manifold 61 and connected downstream thereof with a muffler 65 provided at the rear (not shown) of the vehicle. Further, there is provided with a three-way catalyst 66 at the upstream portion of the muffler 65. Further, there is provided with an oxygen sensor 67 at the immediately upstream portion of the three-catalyst 66 for finding the air-fuel ratio by detecting an oxygen density in exhaust gas.

Further, in order to detect engine operating conditions, there are provided with an air-flow meter 58 for detecting the intake air amount Q and a throttle opening angle sensor 59 for detecting a throttle opening angle θ of the throttle valve 55 in the air intake passageway 50.

Further, the control system has an electronic control unit (hereinafter referred to as ECU) 70 to which signals from the above described sensors are inputted and from which control signals are outputted to miscellaneous control means.

Figure 2:
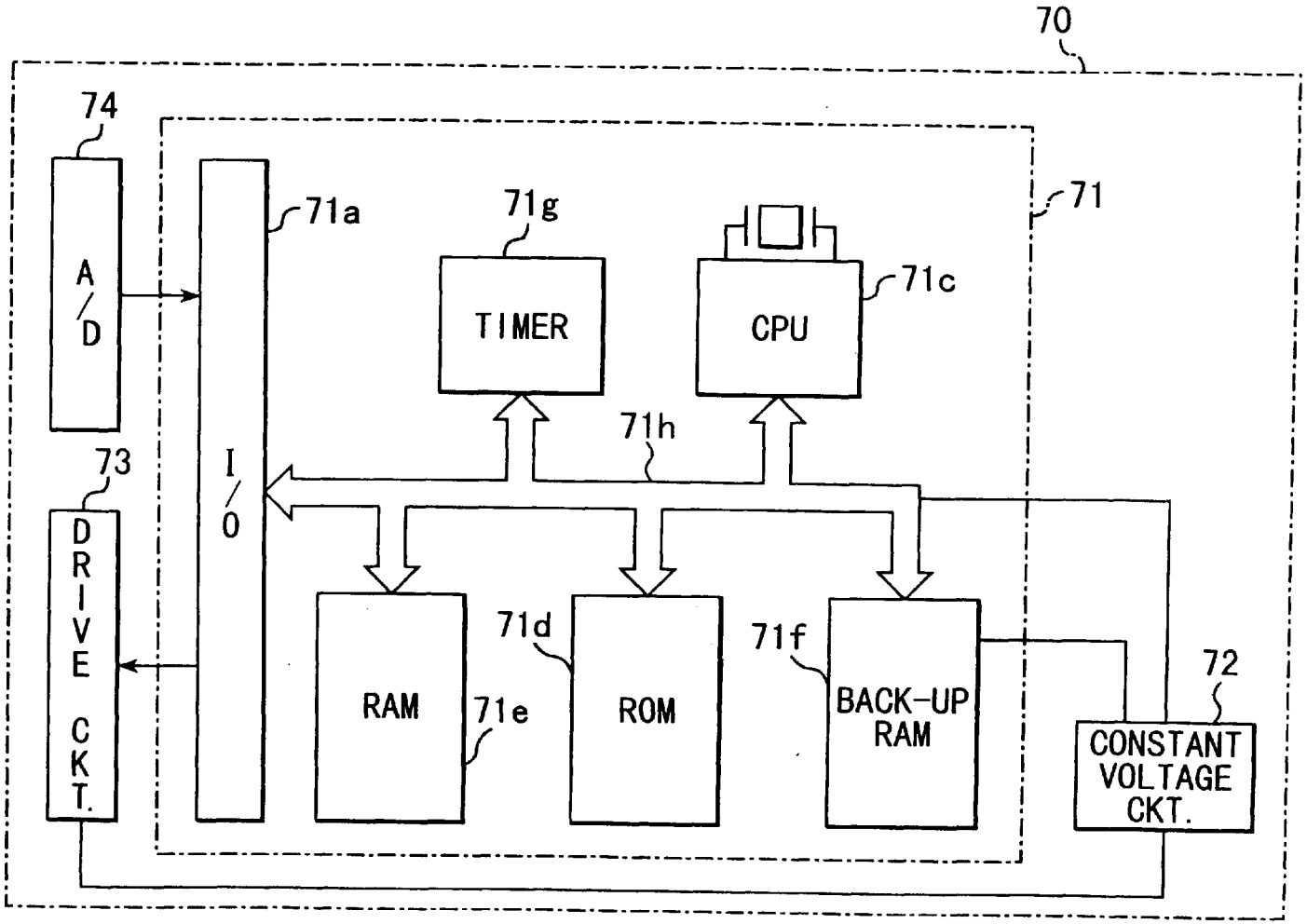
FIG. 2 is a schematic view showing a construction of an electronic control unit (ECU) shown in FIG. 1.

FIG. 2 is a schematic view showing an internal construction of the ECU 70. The ECU 70 is mainly composed of a micro-computer 71 which is a central processing and calculating means and a constant voltage circuit 72 for supplying a stable electric power to miscellaneous components, a drive circuit 73 and an A/D converter 74 are incorporated therein.

The micro-computer 71 comprises an input/output interfaface 71*a* for inputting detected signals from miscellaneous sensors of the engine 10 and for outputting control signals to miscellaneous control means, a CPU 71*c* as a major computing apparatus, a ROM 71*d* in which the control program or fixed data are memorized, a RAM 71*e* in which processed data of signals from miscellaneous sensors and data processed in the CPU 71*c* are stored, a backup RAM 71*f* for accommodating learned data and the like, a timer 71*g* and a bus line 71*h* for connecting these components with each other.

Figure 3:
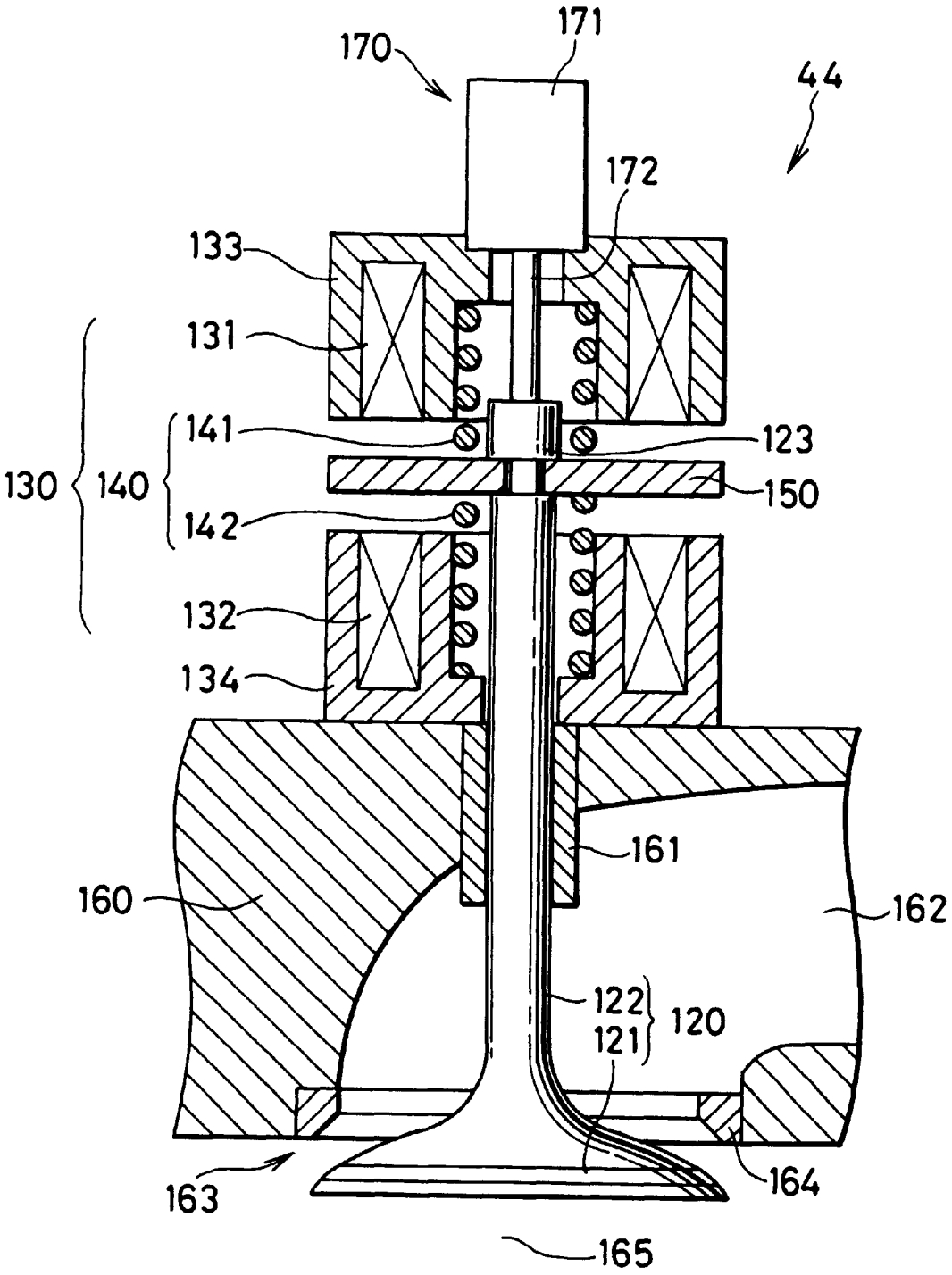
FIG. 3 is a schematic view showing an exhaust valve and an actuator illustrated in FIG. 1.
Figure 14:
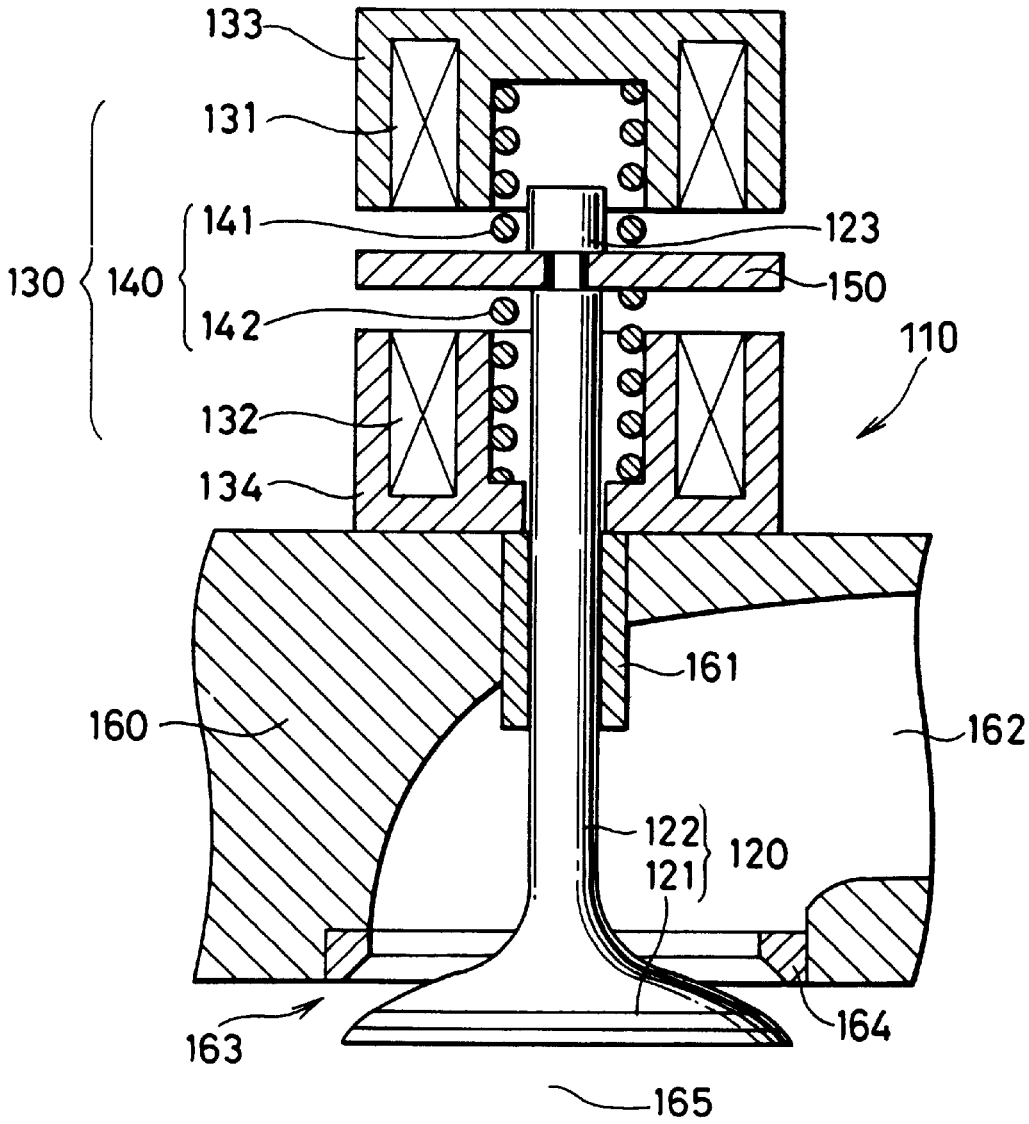
FIG. 14 is a schematic view of an electromagnetically operated valve mechanism according to the prior art.

FIG. 3 is a schematic explanatory diagram of the exhaust valve 41 and the actuator 44 shown in FIG. 1. The construction and components of the valve mechanism shown in FIG. 1 which are almost the same as those shown in FIG. 14 are denoted by identical reference numerals and are not described in detail.

As shown, on the first core 133 there is provided a lift sensor 170 for sensing the open and closed state of the valve body 120, namely, the amount of lift of the valve body 120 and for outputting the amount of lift as an analogue signal "v". The lift sensor 170 is constituted of a main body 171 and a sensor shaft 172. The sensor shaft 172 is connected at the lower end thereof with the top end 123 of the valve body 120 and travels vertically being interlocked with the opening and closing movement of the valve body 120. The main body 171 detects the traveling amount of the sensor shaft 172 as a lift amount of the valve body 120 and outputs the lift amount as an analogue signal "v".

The lift sensor 170 is one kind of displacement meter which detects the position of the valve body 120 by measuring a traveling distance from the reference point. In this embodiment, the lift sensor 170 is a noncontacting type displacement meter using eddy current. Other types of displacement meter such as using laser, ultrasonic, infrared and the like may be employed.

Figure 4:
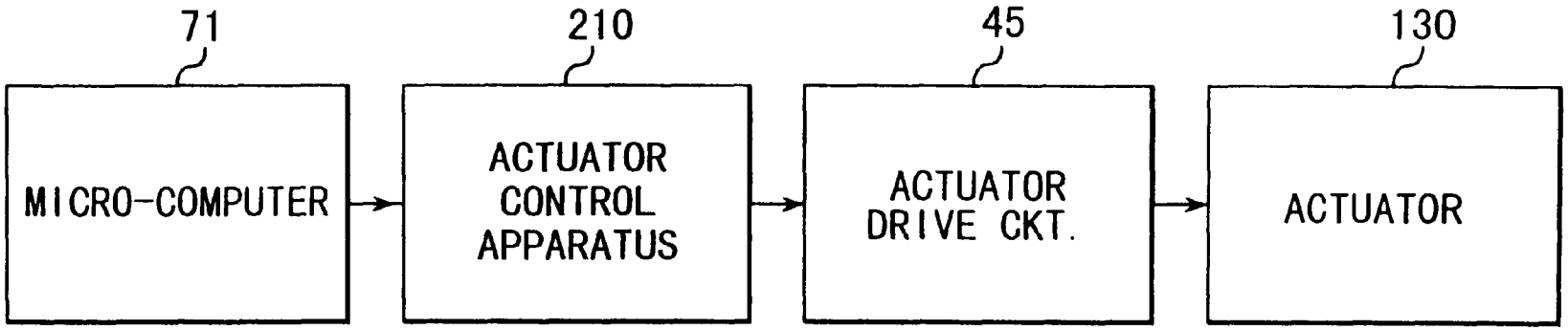
FIG. 4 is a basic functional block diagram of an electromagnetically operated valve control system according to the present invention.

FIG. 4 is a basic functional block diagram for explaining the feature of the present invention. In which, the micro-computer 71 calculates miscellaneous data of the engine and generates control data such as a valve hold period. An actuator control apparatus 210 is for energizing and deenergizing the actuator 44 through the actuator drive circuit 45 based on the control data from the micro-computer 71 and on the analogue signal from the lift sensor 170. Therefore, the electromagnetically operated valve control system according to the present invention is characterized in that the valve drive control is relied only upon the actuator control apparatus 210 which is provided separately from the micro-computer 71.

Next, a first embodiment will be described with reference to FIG. 5, FIG. 6 and FIG. 7.

Figure 5:
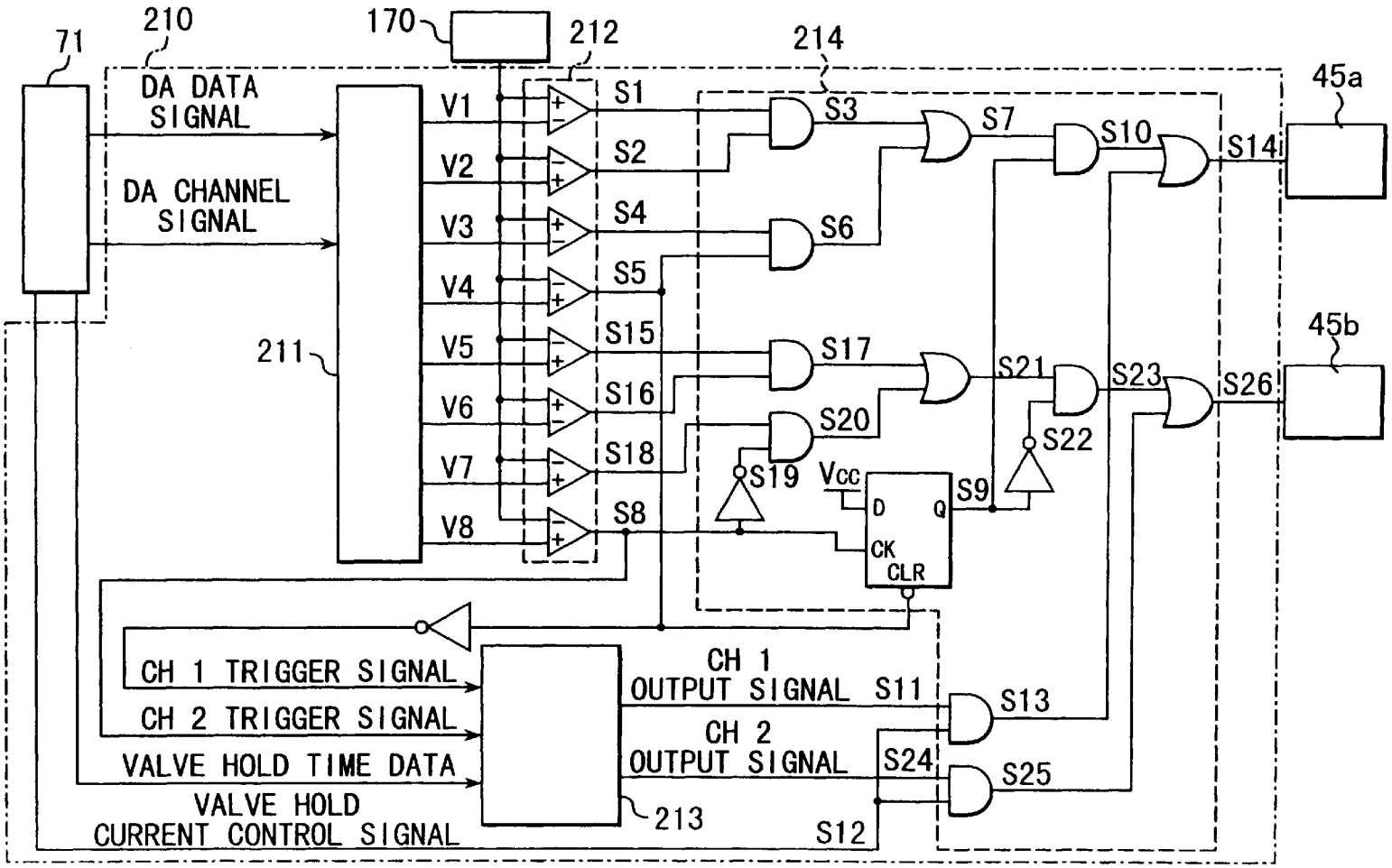
FIG. 5 is a block diagram of an elecromagnetically operated valve control system according to a first embodiment of the present invention.
Figure 6:
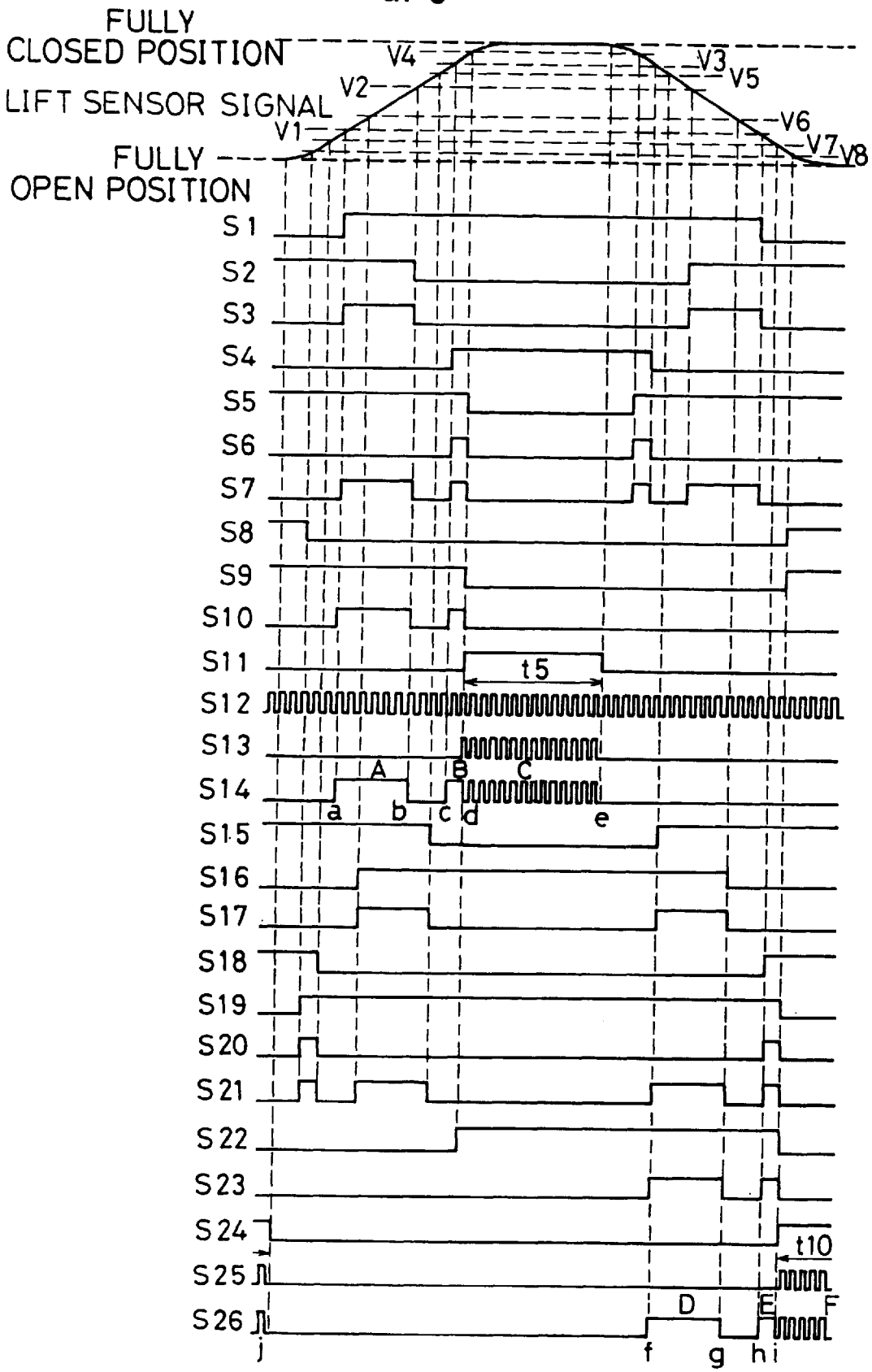
FIG. 6 is a timing chart showing an ON-OFF operation of miscellaneous control signals according to a first embodiment.

As shown in FIG. 5, the electromagnetically operated valve control system incorporates the micro-computer 71 and the actuator control apparatus 210. The actuator control apparatus 210 comprises a digital-to-analogue conversion circuit (hereinafter, referred to as DA conversion circuit) 211, a comparison circuit 212, a timer circuit 213 and a valve control signal output section 214.

Further, the actuator drive circuit 45 comprises a valve closing solenoid drive circuit 45*a* and a valve opening solenoid drive circuit 45*b*.

The micro-computer 71 outputs a digital data signal and a digital channel signal to the DA conversion circuit 211. Further, the micro-computer 71 outputs a valve hold time data to the timer circuit 213 and a valve hold current control signal to the valve control signal output section 214, respectively.

The digital data signal and the digital channel signal are are used for outputting specified reference analogue signals v1 to v8 to specified channels. The valve hold time data signal is a signal for indicating a period during which the valve is held at the fully open position or at the fully closed position. The valve hold current control signal is a signal for holding the valve at the fully open or fully closed position.

The DA conversion circuit 211 outputs specified reference analogue signals v1 to v8 to specified channels based on the digital data signal and the digital channel signal inputted from the micro-computer 71. These analogue signals v1 to v8 are compared to an analogue signal "v" which is outputted when the valve body 120 is at a specified lift position.

The comparison circuit 212 compares the reference analogue signals v1 to v8 outputted from the DA conversion circuit 211 with the analogue signal "v" outputted from the lift sensor 170 to detect the open and closed state of the valve body 120. In the comparison circuit 212, when a "+" input signal is larger than a "−" input signal, a high level signal (hereinafter, referred to as Hi) is outputted and on the contrary when a "+" input signal is smaller than a "−" input signal, a low level signal (hereinafter, referred to as Lo) is outputted.

In the first embodiment and embodiments which will be described hereinafter, the reference analogue signals v1 to v8 are generated in the DA conversion circuit 211, however other generating means such as a resistive divider and the like may be introduced.

Accordingly, as a result of the comparison of the analogue signal "v" with the reference analogue signals v1 to v8, the current position of the valve body 120 can be known. Further, it is possible to know the traveling state of the valve body 120 by investigating its positional change. The traveling state of the valve body 120 is outputted to the timer circuit 213 and the valve control signal output section 214, respectively.

The timer circuit 213 is constituted by a one-shot pulse generating circuit with two channels. When a specified input signal is inputted from the comparison circuit 212, being triggered by a leading edge of the input signal, a specified signal based on the valve holding time data inputted from the micro-computer 71 is outputted to the valve control signal output section 214 for a specified period.

The valve control signal output section 214 is a logical circuit constituted by an AND circuit, an OR circuit, an inverter circuit and a flip-flop circuit and it outputs a valve closing signal s14 and a valve opening signal s26 to the valve closing solenoid drive circuit 45*a* and the valve opening solenoid drive circuit 45*b*, respectively according to the position of the valve body 120.

Further, the valve closing solenoid drive circuit 45*a* and the valve opening solenoid drive circuit 45*b* supplies current to the valve closing solenoid 131 and the valve opening solenoid 132 in the actuator 44 based on the valve closing signal s14 and the valve opening signal s26, respectively.

Next, an opening and closing operation of the valve body 120 according to the first embodiment will be described. FIG. 7 is a diagram showing the movement of the valve body 120 and the timing of the valve driving signals. The shown lift sensor signal is a signal "v" which is detected by a lift sensor 170 to be compared with shown specified positions v1, v2, v3, etc. The valve closing solenoid drive signal indicates a signal s14 (shown in FIG. 6) to be outputted from the valve control signal output section 214 to the valve closing solenoid circuit 45*a* and the valve opening solenoid drive signal indicates a signal s26 (shown in FIG. 6) to be outputted from the valve control signal output section 214 to the valve opening solenoid circuit 45*b*.

Figure 7:
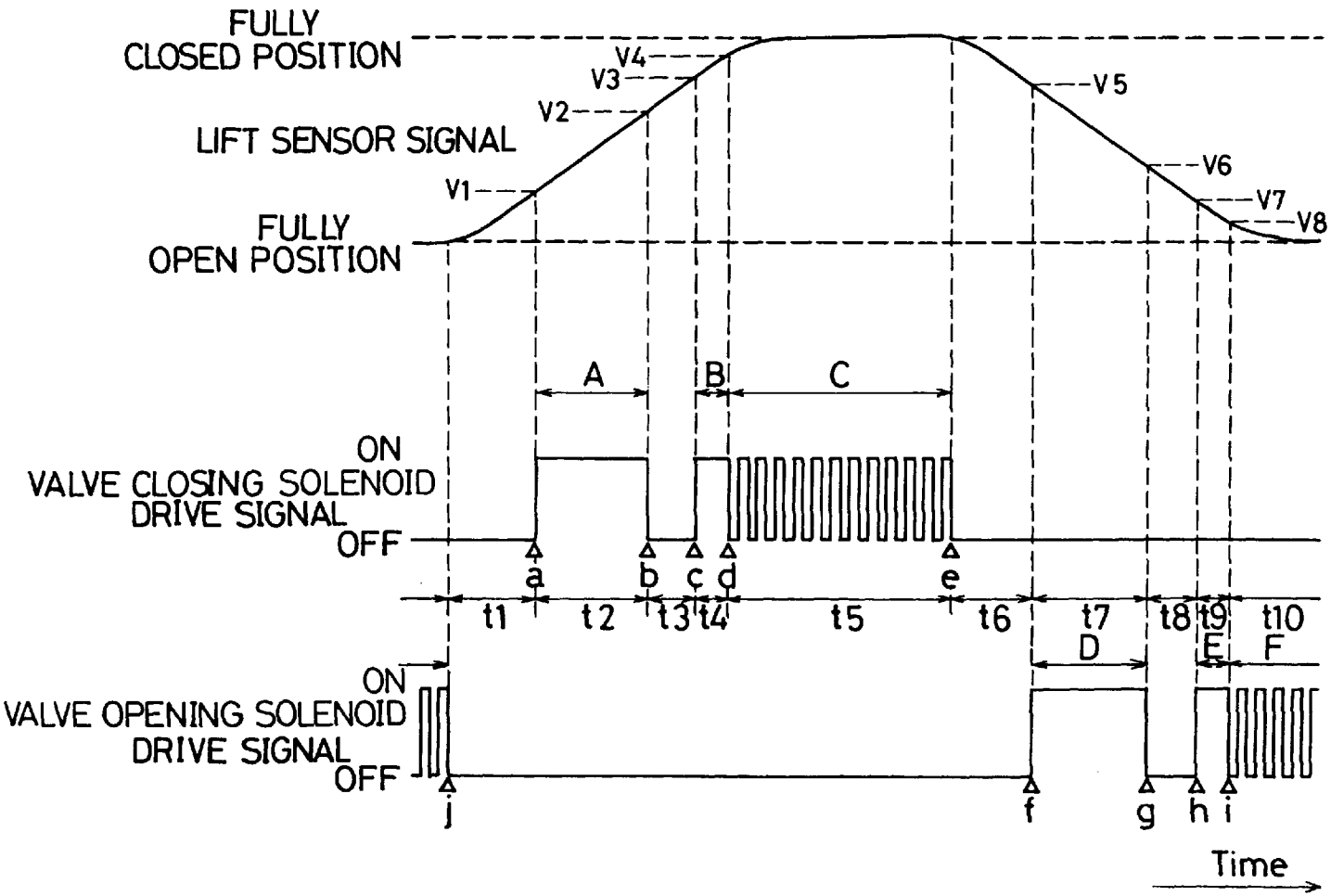
FIG. 7 is a timing chart showing an closing and opening operation of a valve body in conjunction with the ON-OFF timing of valve closing and opening solenoids according to a first embodiment.

First, when the valve opening solenoid drive signal s26 is turned OFF at a time "j" in FIG. 7, the valve opening solenoid 132 is deenergized. Thus, the armature 150 loses attraction force and as a result the valve body 120 starts to move towards the closing side by the spring force of the valve closing spring 142. After that, when the analogue signal "v" of the lift sensor 170 becomes larger than a reference analogue signal v1, the valve closing signal s14 is turned ON at a time "a" in FIG. 7. Therefore, the valve closing solenoid 131 is energized, the armature 150 is attracted by the valve closing coil 131 and the valve body 120 continues to move towards the closing side against the biasing force of the valve opening spring 141.

Then, when the analogue signal "v" of the lift sensor 170 becomes larger than a reference analogue signal v2, the valve closing signal s14 is turned OFF at a time "b" in FIG. 7. Thus, a valve closing acceleration signal "A", namely, a signal for accelerating the armature 150 and seating the valve body 120 at an approximate constant velocity, has been formed.

When the valve closing solenoid drive signal s14 is turned OFF, the valve closing solenoid 131 is deenergized and the armature 150 loses attraction force. As a result, the armature 150 is stopped to be attracted, however, inertia force allows the valve body 120 to continue to move toward the closing side.

Further, when the analogue signal "v" of the lift sensor 170 becomes larger than a reference analogue signal v3, the valve closing solenoid drive signal s14 is turned ON at a time "c" in FIG. 7. Thus, the valve closing solenoid 131 is energized and attraction force is generated in the armature 150 to accelerate again the valve body 120 toward the closing side. Further, when the analogue signal "v" of the lift sensor 170 becomes larger than a reference analogue signal v4, the valve closing solenoid drive signal s14 is turned OFF at a time "d" in FIG. 7. Thus, a valve seating velocity adjusting signal "B", namely, a signal for making a fine adjustment to the valve speed at which the valve body 120 is seated on the valve seat 164, has been formed between the time "c" and the time "d".

When the valve closing solenoid drive signal s14 is turned OFF at a time "d", being triggered by a trigger signal (channel 1 signal) at a trailing edge of the signal, a valve closing hold signal "C" composed of a PWM signal is outputted during a specified period t5 between the time "d" and the time "e". This specified time t5 is determined in the micro-computer 71 according to engine operating conditions. As a result, the valve body 120 is kept fully closed until the time "e".

Describing an opening operation of the valve body 120, when the valve closing solenoid drive signal s14 is turned OFF at a time "e" in FIG. 7, the valve closing solenoid 131 is deenergized and the valve body 120 starts to move toward the opening side by the valve opening spring 141.

When the analogue signal "v" of the lift sensor 170 becomes smaller than a reference analogue signal v5 being accompanied by the movement of the valve body 120, the valve opening solenoid drive signal s26 is turned ON at a time "f" shown in FIG. 7. As a result, the valve body 120 continues to move toward the opening side by the attracting force of the valve opening solenoid 132. Then, when the analogue signal "v" becomes smaller than a reference analogue signal v6, the valve opening solenoid drive signal s26 is turned OFF at a time "g" shown in FIG. 7. Thus, a valve opening acceleration signal "D", namely, a signal for accelerating the valve body 120 to an approximate constant speed, has been formed between "f" and "g".

Since the inertia force is applied to the valve body 120 in the opening direction, the valve body 120 continues to move to the opening side. Then, when the analogue signal "v" becomes smaller than a reference analogue signal v7, the valve opening solenoid drive signal s26 is turned ON again at a time "h" shown in FIG. 7.

Then, an attracting force is generated in the valve opening solenoid 132 and the valve body 120 continues to move toward the opening side. When the analogue signal "v" becomes smaller than a reference analogue signal v8, the valve opening solenoid drive signal s26 is turned OFF at a time "i" shown in FIG. 7. Thus, a valve opening velocity adjusting signal "E", namely, a signal for making a fine adjustment to the valve speed at which the valve body 120 is fully open, has been formed between "h" and "i".

When the valve closing solenoid drive signal s26 is turned OFF at "i", being triggered by a trigger signal (channel 2 signal) at a trailing edge of the signal, a valve opening hold signal "F" composed of a PWM signal is outputted during a specified period t10. This specified period t10 is determined in the same manner as t5. Thus, the valve body 120 is kept fully open until "j".

As described above, according to the first embodiment, since the width of the valve closing acceleration signal "A" and the seating speed adjusting signal "B" are determined by the position of the valve body 120, when the traveling speed of the valve body 120 is lowered due to a voltage drop of the battery or an increase of resistance of electromagnetic coils caused by temperature rise for example, the elongated applying time of the drive signal compensates for the traveling speed of the valve body 120.

Especially, when the valve is seated, the elongated applying time of the drive signal compensates the seating speed of the valve body 120, thereby inadequate seatings or void seatings can be prevented.

Further, since the micro-computer 71 has such small functions as supplying when needed the digital data to the DA conversion circuit 212 and the valve hold time data to the timer circuit 213, respectively and since the valve drive control is relied upon the actuator control apparatus 210 but not upon the micro-computer 71, it is possible to lessen a burden on the micro-computer 71 substantially.

Next, a second embodiment of the present invention will be described. The feature of the second embodiment is to determine a timing for turning the valve seating velocity adjusting signal "B" off based on an elapsed time since the valve seating velocity adjusting signal "B" is turned ON, but not on a position of the valve body 120 and an object of the second embodiment is to reduce the seating speed of the valve body 120.

In case of determining the OFF timing of the valve seating velocity adjusting signal "B" by the lift value, if the duration of the valve seating velocity adjusting signal "B" is elongated due to an insufficient acceleration of the armature 150 by the valve opening acceleration signal "A", it is likely that the seating speed becomes rather large due to the further acceleration of the valve seating velocity adjusting signal "B". In this case, the valve closing acceleration signal "A" must be adjusted so that the valve body 120 has a traveling speed larger than a given value.

In the second embodiment, the control for reducing the seating speed is performed by the actuator control apparatus 210. The construction and operation will be described with reference to FIG. 8 and FIG. 9.

Figure 8:
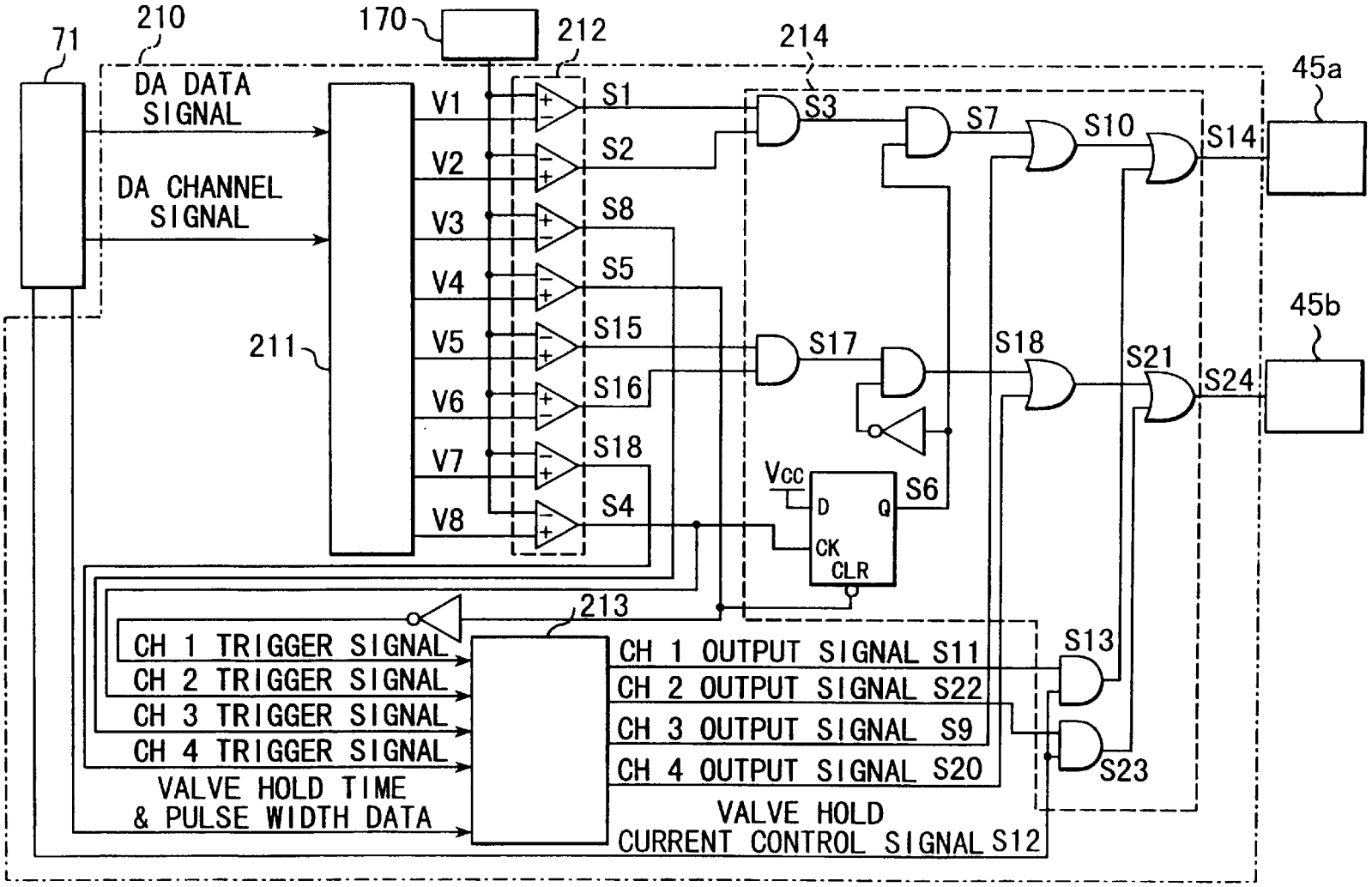
FIG. 8 is a block diagram of an elecromagnetically operated valve control system according to a second embodiment of the present invention.
Figure 9:
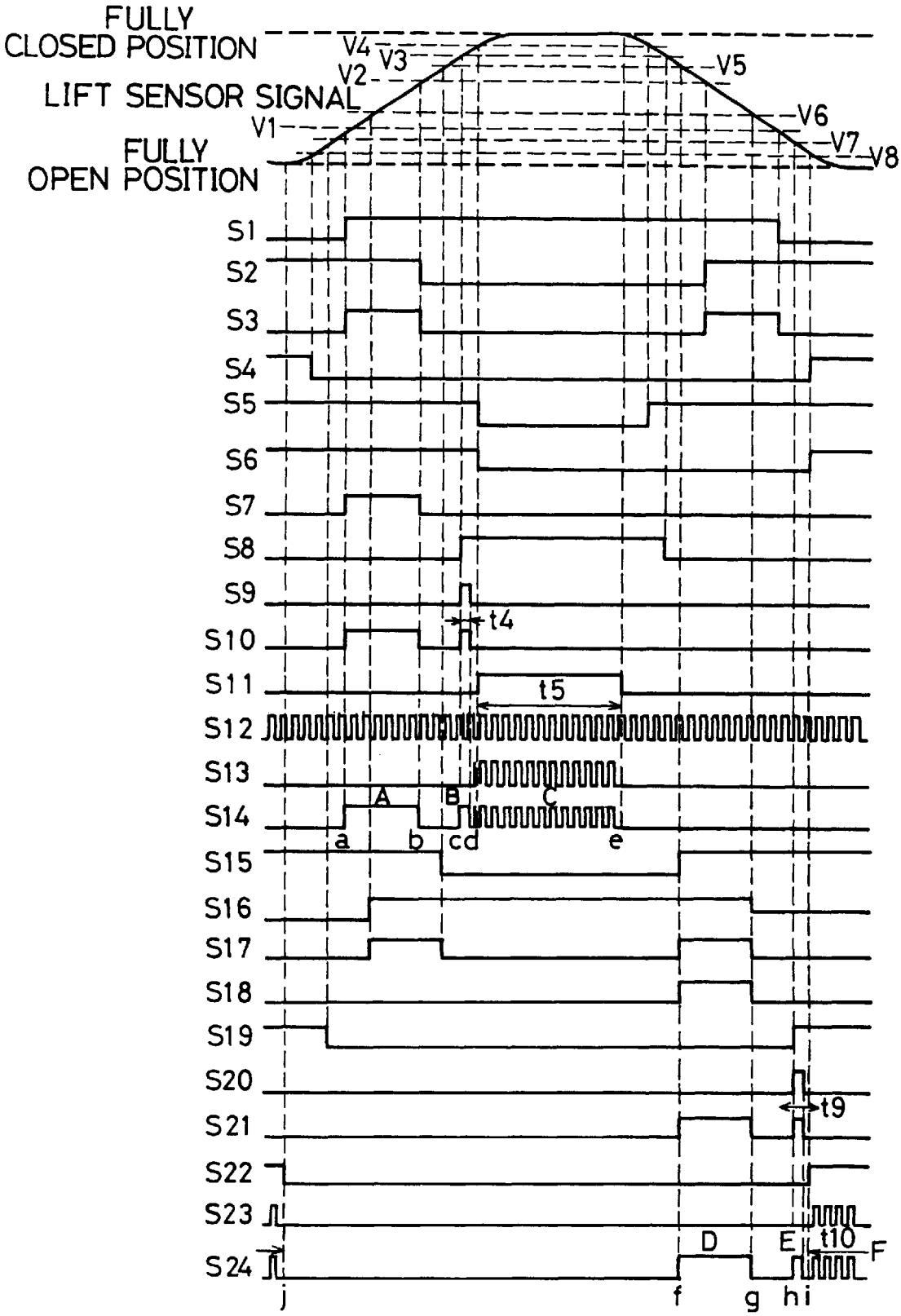
FIG. 9 is a timing chart showing an ON-OFF operation of miscellaneous control signals according to a second embodiment.

FIG. 8 is a block diagram of the system according to the second embodiment and FIG. 9 is a timing chart showing the ON-OFF operation of signals s1 through s24 in the valve control signal output section 214 illustrated in FIG. 8. The components of the second embodiment shown in FIG. 8 which are identical to those of the first embodiment shown in FIG. 5 are denoted by identical reference numerals and are not described in detail.

A signal s14 is a valve closing solenoid drive signal to be outputted to the valve closing solenoid drive circuit 45*a* and a signal s24 is a valve opening solenoid drive signal to be outputted to the valve opening solenoid drive circuit 45*b*. As shown in FIG. 8, when it is judged that the analogue signal "v" exceeds a reference analogue signal v3, a trigger signal (channel 3) is outputted to the timer circuit 213.

Then, the timer circuit 213 outputs a signal s9 for a specified period t4. Therefore, the valve seating velocity adjusting signal "B" is turned ON at "c" and, after a specified period t4 elapses, it turned OFF. Similarly, the valve opening velocity adjusting signal "B" is turned ON at "h" and turned OFF after a specified period t9 elapses. These specified periods t4 and t9 are determined in the micro-computer 71 based on the engine operating conditions.

Accordingly, in this embodiment, the valve seating velocity adjusting signal "B" is turned OFF after a specified period t4 elapses since "c" in contrast to the fist embodiment where the valve seating velocity adjusting signal "B" is turned OFF at "d" and at the same time the valve closing hold signal "C" is turned ON and only valve closing hold signal "C" is turned ON at "d". Further, the valve opening velocity adjusting signal "E" is turned OFF after a specified period t9 elapses since "h" and only valve opening hold signal "F" is turned ON at "i".

Thus, a period during which the valve seating velocity adjusting signal "B" is turned ON can be shortened and the seating speed of the valve body 120 can be substantially reduced. Further, the valve opening speed also can be reduced largely.

Immediately before the seating velocity adjusting signal "B" is turned OFF, the rate of change of the analogue signal "v" of the lift sensor 170 is small, because the timing when the valve seating velocity adjusting signal "B" is turned OFF is located at an area just before the valve body 120 is seated. Therefore, in case where the noise level of the analogue signal "v" is relatively large, the pulse width tends to vary or the chattering phenomenon is caused easily. However, according to this second embodiment, since the OFF timing of the valve seating velocity adjusting signal "B" is controlled by time, such defects can be eliminated.

Next, describing a third embodiment of the present invention, the feature of the third embodiment is to determine the ON timing of the valve closing acceleration signal "A" by an elapsed time since the OFF timing of the valve opening hold signal "F" and its object is to stabilize the ON timing of the valve closing acceleration signal "A" and also that of the valve opening acceleration signal "D".

Generally, since the electromagnetic generating means 130 comprises a magnetic solenoid including a magnetic core, even if the magnetic solenoid is deenergized, the electromagnetic force does not disappear instantly due to the hysteresis characteristic of the magnetic core.

That is to say, when the valve closing hold signal "C" is turned OFF and then the valve opening acceleration signal "D" is turned ON, the velocity of the valve body 120 is reduced due to the residual attraction force of the valve closing coil 131. Similarly, the velocity of the valve body 120 is reduced due to the residual attraction force of the valve opening solenoid 132. Hence, the gradient of the analogue signal "v" becomes small as much at "a" and "f".

Because of this, in case where the noise level of the analogue signal "v" is relatively large, the ON timing of the valve closing acceleration signal "A" shows variations or chatterings are caused.

Figure 10:
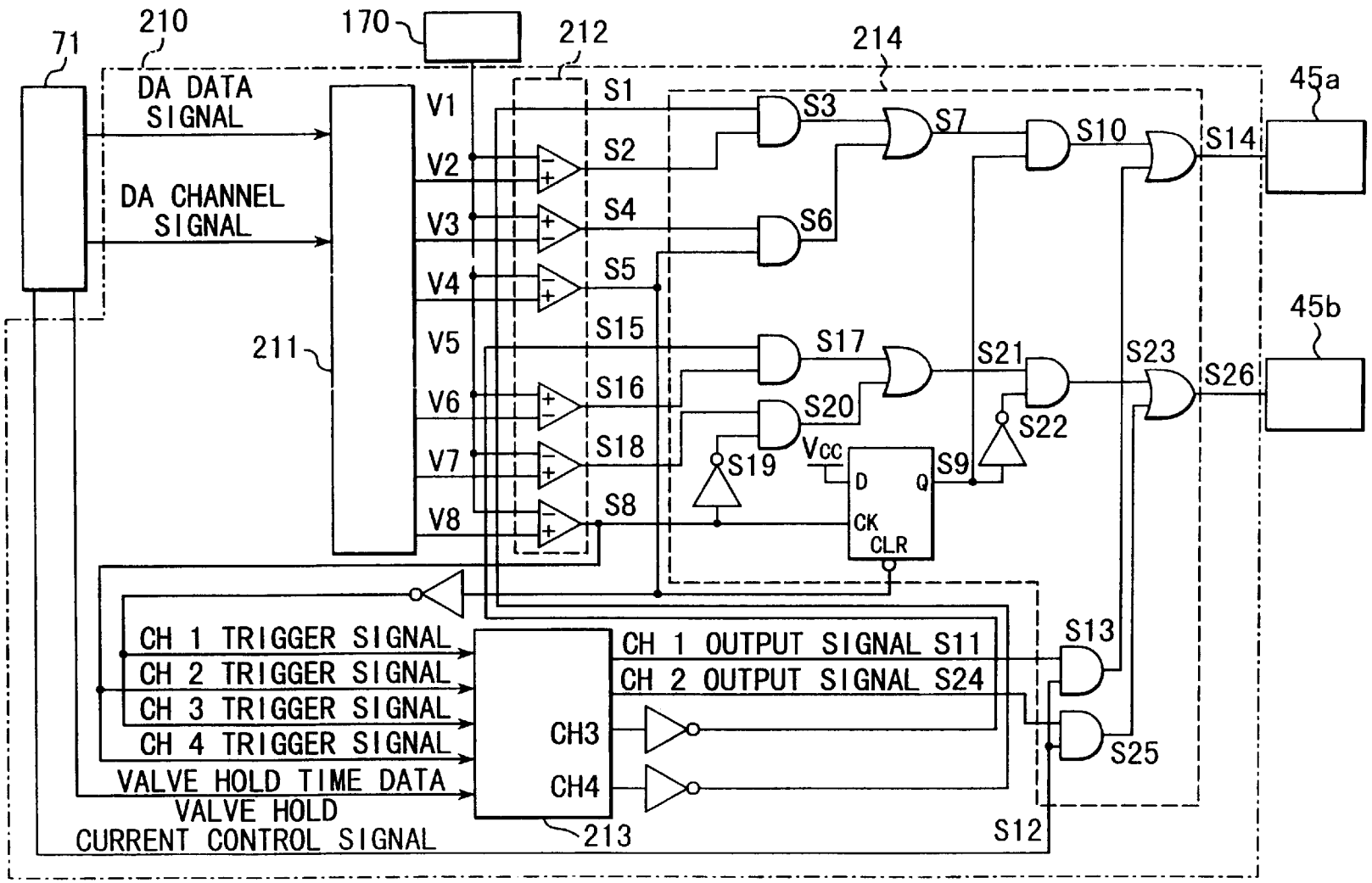
FIG. 10 is a block diagram of an elecromagnetically operated valve control system according to a third embodiment of the present invention.
Figure 11:
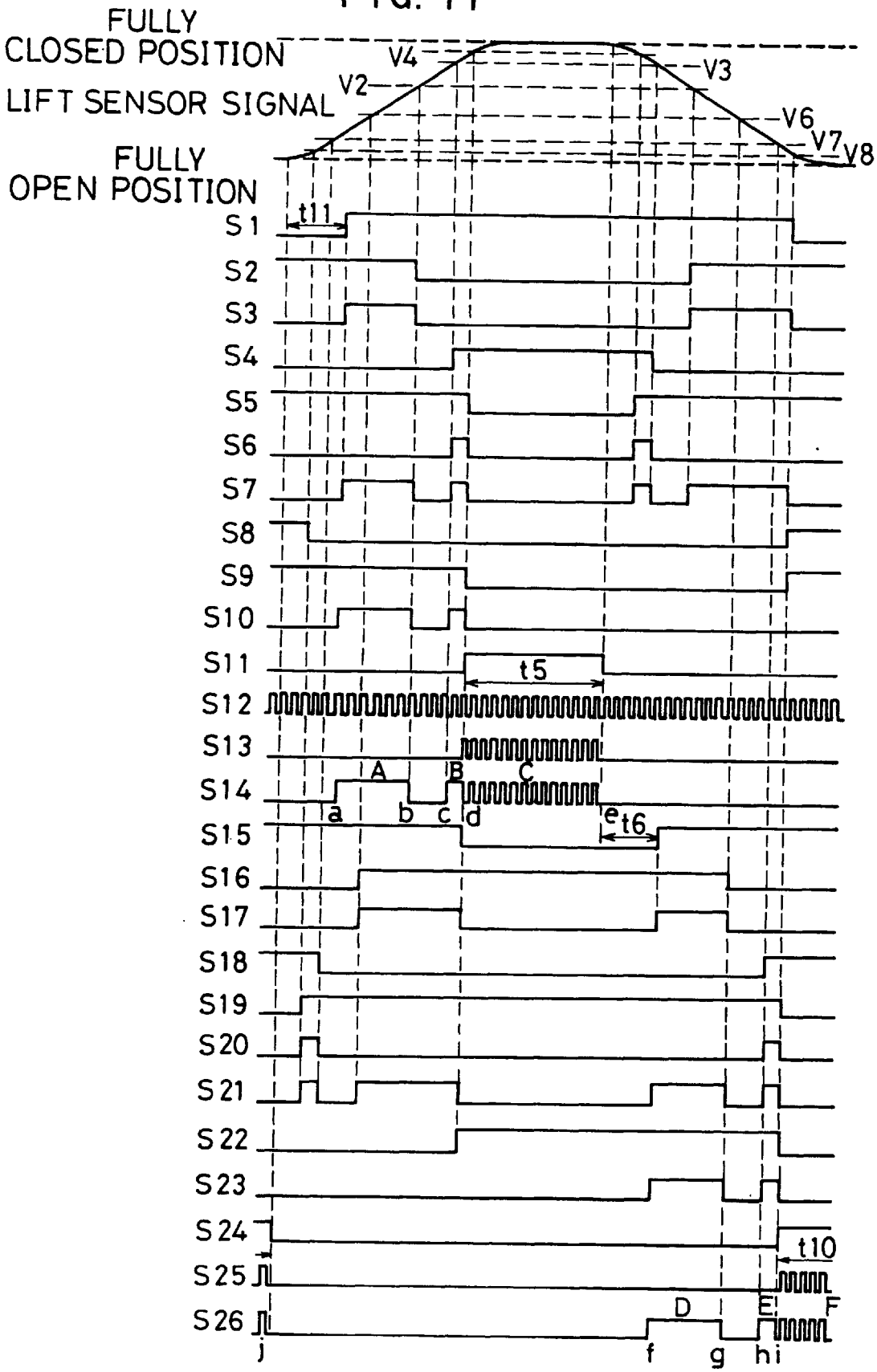
FIG. 11 is a timing chart showing an ON-OFF operation of miscellaneous control signals according to a third embodiment.

FIG. 10 is a block diagram of the third embodiment and FIG. 11 is a timing chart of signals S1 through S26 in the valve control signal output section 214 shown in FIG. 10. In FIG. 11, the signal s14 is a valve closing solenoid drive signal to be outputted to the valve closing solenoid drive circuit 45*a* and the signal 26 is a valve opening solenoid drive signal to be outputted to the valve opening solenoid drive circuit 45*b*. The components of the third embodiment shown in FIG. 10 which are identical to those of the first embodiment shown in FIG. 5 are denoted by identical reference numerals and are not described in detail.

In FIG. 10, when it is judged in the comparison circuit 212 that the analogue signal "v" of the lift sensor 170 becomes larger than the reference analogue signal v4, ch1 and ch3 trigger signals are inputted to the timer circuit 213, respectively.

Then, as indicated in FIG. 11, the timer circuit 213 outputs a ch1 output signal s1 for a specified period t5 and at the same time outputs an inverted ch3 output s15 for a specified period t5+t6.

Therefore, the valve opening acceleration signal "D" is turned ON (time "f") after a specified period t6 has elapsed since the valve closing hold signal "C" is turned OFF (time "e").

Similarly, the valve closing acceleration signal "A" is turned ON (time "a") after a specified period t11 has elapsed since the valve opening hold signal "F" is turned OFF (time "j"). These specified periods of time t6 and t11 are determined in the micro-computer 71 according to the engine operating conditions.

Accordingly, the ON timing of the valve closing acceleration signal "A" can be determined based on the elapsed time since the valve opening hold signal "F" is turned OFF. Similarly, the ON timing of the valve opening acceleration signal "D" can be determined according to the elapsed time since the valve closing hold signal "C" is turned OFF. Thus, the ON timing of the valve closing acceleration signal "A" and the ON timing of the valve opening acceleration signal "D" can be stabilized and this results in preventing variations of the ON timing of the valve closing acceleration signal "A" and the valve opening acceleration signal "D" or eliminating chatterings of the valve body 120.

Next, describing a fourth embodiment of the present invention, the fourth embodiment is characterized in that the OFF timing of the valve closing acceleration signal "A" and that of the valve opening acceleration signal "D" are determined by an elapsed time since the valve closing acceleration signal "A" and the valve opening acceleration signal "D" are turned ON, but not by the position of the valve body 120 and its object is to prevent the electromagnetic solenoid from burning due to inadequate seatings.

In case of determining the OFF timing of the valve closing acceleration signal "A" or the valve opening acceleration signal "D" based on the position of the valve body 120, there is a possibility that the period during which the valve closing acceleration signal "A" or the valve opening acceleration signal "D" is turned ON is elongated, when the valve body 120 is seated or open insufficiently.

It is an object of this embodiment to prevent the electromagnetic solenoid from burning at the event of insufficient seating of the valve body by providing a threshold value in the "ON" period.

Figure 12:
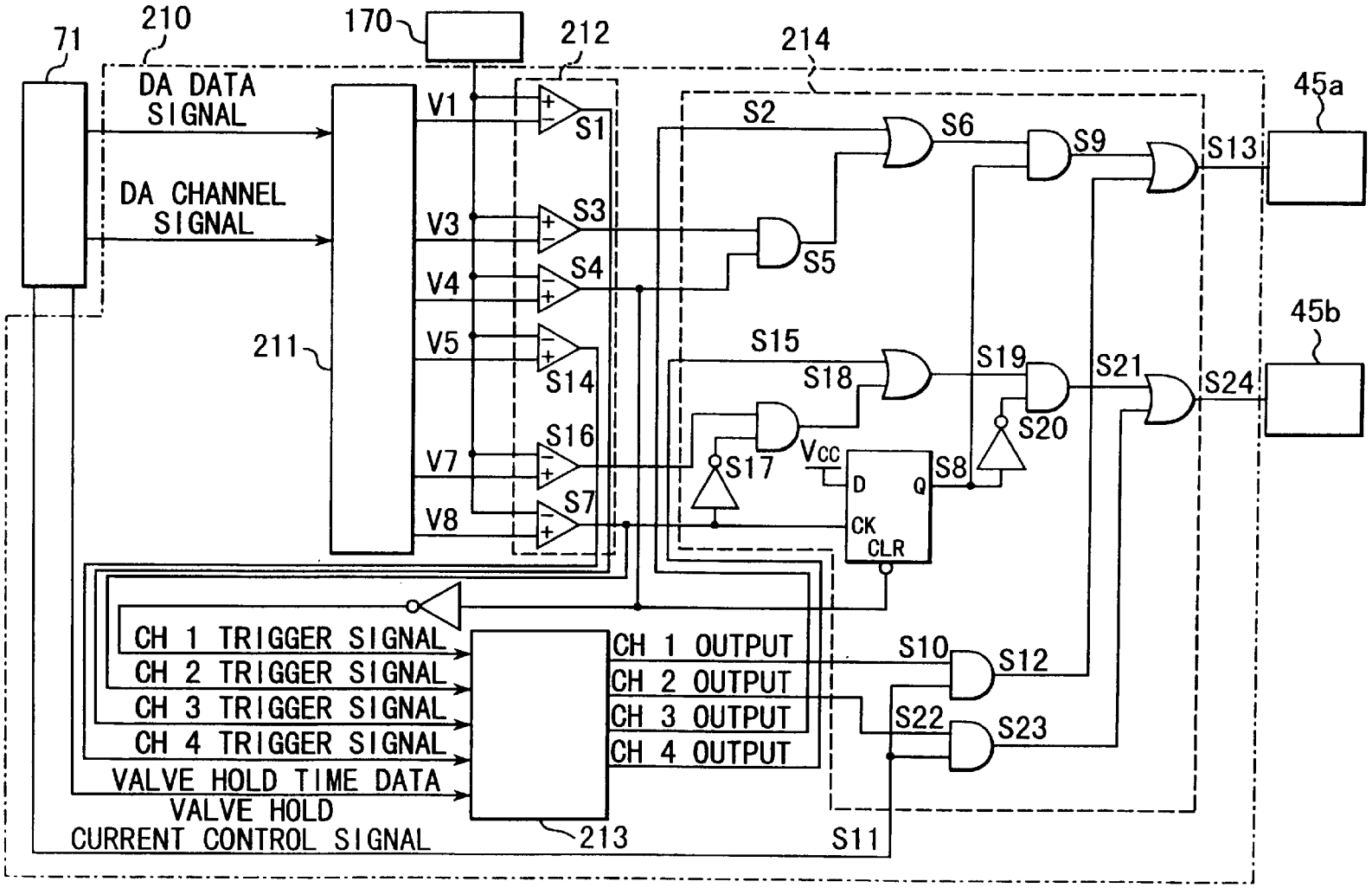
FIG. 12 is a block diagram of an elecromagnetically operated valve control system according to a fourth embodiment of the present invention.
Figure 13:
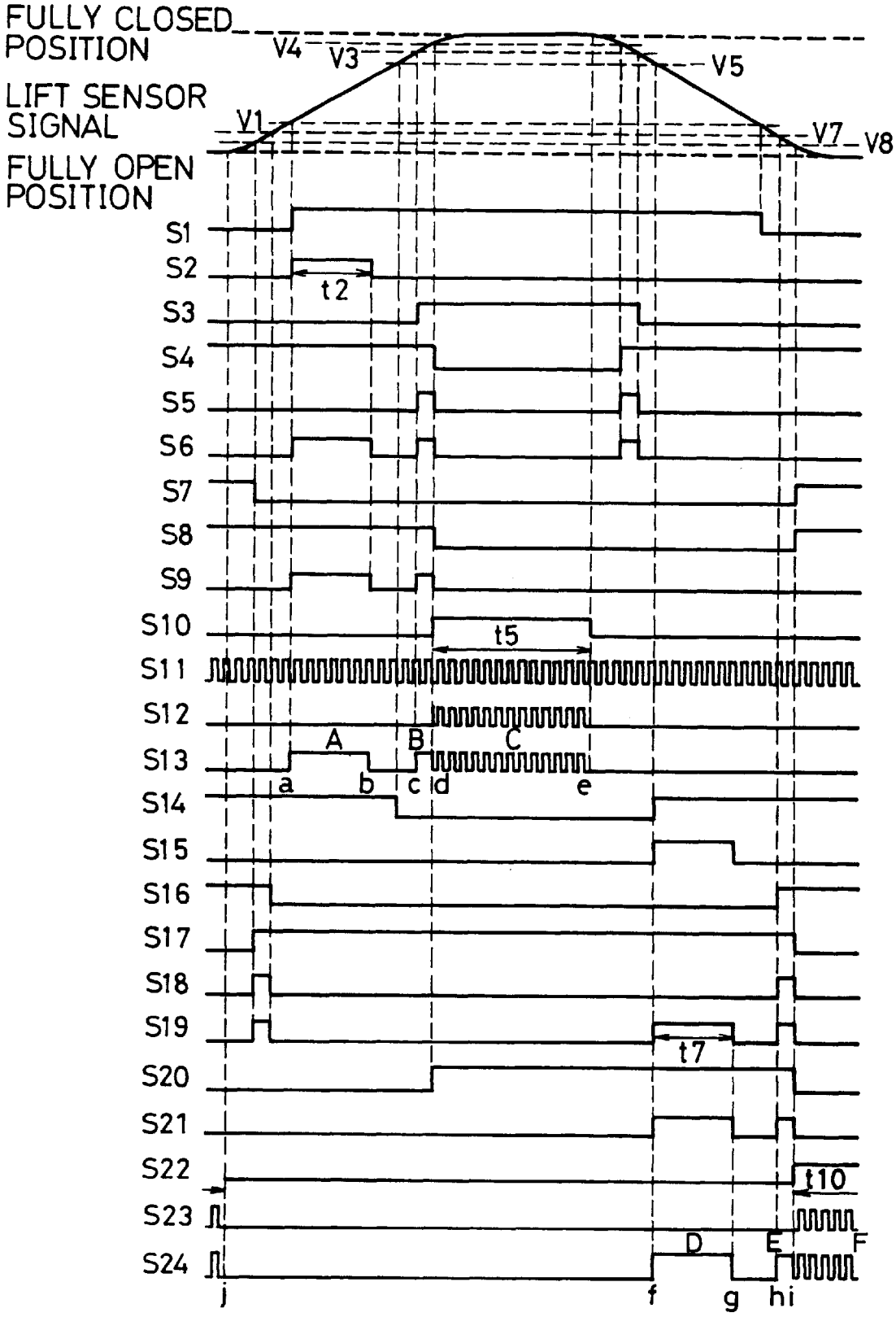
FIG. 13 is a timing chart showing an ON-OFF operation of miscellaneous control signals according to a fourth embodiment.

FIG. 12 is a block diagram of the valve control system according to the fourth embodiment and FIG. 13 is a timing chart of signals s1 through s24 in the valve control signal output section 214 shown in FIG. 12. The signal s13 in FIG. 13 is a valve closing solenoid drive signal to be outputted to the valve closing solenoid drive circuit 45*a* and the signal s24 is a valve opening solenoid drive signal to be outputted to the valve opening solenoid drive circuit 45*b*. The components of the fourth embodiment shown in FIG. 12 which are identical to those of the first embodiment shown in FIG. 5 are denoted by identical reference numerals and are not described in detail.

Referring to FIG. 12, when it is judged in the comparison circuit 212 that the analogue signal "v" of the lift sensor 170 becomes larger than the reference analogue signal v1, a ch3 trigger signal is inputted to the timer circuit 213 and then, as indicated in FIG. 13, the timer circuit 213 outputs a ch3 output signal s2 for a specified period t2.

Accordingly, the valve closing acceleration signal "A" is turned OFF after a specified period t2 has elapsed since it is turned ON (time "a"). Similarly, the valve opening acceleration signal "D" is turned OFF after a specified period t7 has elapsed since it is turned ON (time "f"). These periods of time t2 and t7 are determined in the micro-computer 71 according to the engine operating conditions. Namely, the OFF timing of the valve closing acceleration signal "A" can be determined by an elapsed time since the valve closing acceleration signal "A" is turned ON and also the OFF timing of the valve opening acceleration signal "D" can be determined by an elapsed time since the valve opening acceleration signal "D" is turned ON. Thus, it is possible to prevent the electromagnetic solenoid from burning by restricting current passing through the valve closing solenoid 131 or the valve opening solenoid 132 in the event of inadequate seating of the valve body.

In summary, the electromagnetically operated valve control system according to the present invention can alleviate a burden on the micro-computer (central computing and processing means) and perform a more sophisticated control to numerous electromagnetic valves. Therefore, it is possible to reduce the size of the micro-computer and also to lower the cost thereof. Further, the seating control of the valve body which is one of the features of this valve control system can improve durability and quietness of the system.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. An electromagnetically operated valve control system for an engine having a combustion chamber, a valve body reciprocating between a fully closed position and a fully open position so as to open and close said combustion chamber, an actuator connected with said valve body for driving said valve body by energizing and deenergizing a valve closing solenoid and a valve opening solenoid, and an actuator drive circuit for energizing and deenergizing said valve closing solenoid and said valve opening solenoid of said actuator, comprising:

a computer for generating a control data based on operating conditions of said engine; and an actuator control apparatus separately provided from said computer for controlling said actuator drive circuit.

2. The electromagnetically operated valve control system according to claim 1, wherein said actuator control apparatus includes a position detecting section for detecting a position of said valve body, a valve control signal output section for outputting a control signal to operate said actuator drive circuit and a timer circuit for determining an output timing of said control signal based on said position of said valve body.

3. The electromagnetically operated valve control system according to claim 2, wherein said position detecting section includes a lift sensor for outputting said position of said valve body as an analogue signal, a digital-to-analogue conversion circuit for converting a digital signal from said computer into a reference analogue signal corresponding to said position of said valve body, and a comparison circuit for comparing said reference analogue signal with said analogue signal outputted from said lift sensor.

* * * * *